US009773657B2

(12) United States Patent
Böhm

(10) Patent No.: US 9,773,657 B2
(45) Date of Patent: Sep. 26, 2017

(54) TIME-OF-FLIGHT MASS SPECTROMETER WITH SPATIAL FOCUSING OF A BROAD MASS RANGE

(71) Applicant: Bruker Daltonik GmbH, Bremen (DE)

(72) Inventor: Sebastian Böhm, Bremen (DE)

( * ) Notice: Subject to any disclaimer, the term of this patent is extended or adjusted under 35 U.S.C. 154(b) by 0 days.

(21) Appl. No.: 14/883,127

(22) Filed: Oct. 14, 2015

(65) Prior Publication Data

US 2016/0111271 A1 Apr. 21, 2016

(30) Foreign Application Priority Data

Oct. 16, 2014 (DE) ..... 10 2014 115 034

(51) Int. Cl.
*H01J 49/40* (2006.01)
*H01J 49/16* (2006.01)
*H01J 49/06* (2006.01)

(52) U.S. Cl.
CPC ..... *H01J 49/164* (2013.01); *H01J 49/067* (2013.01); *H01J 49/403* (2013.01)

(58) Field of Classification Search
CPC ..... H01J 49/164; H01J 49/40; H01J 49/403; H01J 49/067
See application file for complete search history.

(56) References Cited

U.S. PATENT DOCUMENTS 5,712,479 A * 1/1998 Reilly ..... H01J 49/40 250/282
5,734,161 A * 3/1998 Koster ..... H01J 49/0045 250/282
5,742,049 A * 4/1998 Holle ..... H01J 49/067 250/282
5,905,259 A * 5/1999 Franzen ..... H01J 49/403 250/282

(Continued)

FOREIGN PATENT DOCUMENTS

CN 101170043 A 4/2008
CN 101789355 A 7/2010

(Continued)

OTHER PUBLICATIONS

S.V Kovtoun, et al., "Mass-Correlated Acceleration is a Reflectron MALDI TOF Mass Spectrometer: An Approach for Enhanced Resolution Over a Broad Mass Range", J. Am. Soc. Mass Spectrom 2002, 13, 135-143.*

*Primary Examiner* — Wyatt Stoffa
(74) *Attorney, Agent, or Firm* — Benoit & Côté Inc.

(57) ABSTRACT

The invention relates to time-of-flight mass spectrometers which operate with pulsed ionization of superficially adsorbed analyte substances and with an improvement in the mass resolution by means of a time-delayed start of the ion acceleration; in particular with ion-accelerating voltages which change over time after a delayed start in order to obtain a constant mass resolution over broad mass ranges.

(Continued)

Since the varying acceleration produces a broadening of the ion beam at right angles to the direction of flight, and this broadening increases with the ion mass, the invention proposes to compensate, to the desired extent, for the broadening of the ion beam with the aid of an additional ion-optical lens whose voltage is also varied over time. The invention also relates to measurement methods therefor.

19 Claims, 3 Drawing Sheets

(56) References Cited

U.S. PATENT DOCUMENTS 5,969,348 A * 10/1999 Franzen ..... H01J 49/403 250/282
6,700,117 B2 * 3/2004 Franzen ..... H01J 49/062 250/281
6,740,872 B1 * 5/2004 Holle ..... H01J 49/40 250/281
7,667,195 B2 * 2/2010 Vestal ..... H01J 49/40 250/281
9,048,071 B2 * 6/2015 Satoh ..... H01J 49/0004
2002/0155483 A1 * 10/2002 Holle ..... H01J 49/40 435/6.12
2003/0089848 A1 * 5/2003 Holle ..... H01J 49/40 250/282
2004/0211895 A1 * 10/2004 Green ..... H01J 49/0031 250/281
2005/0269505 A1 12/2005 Ermer
2008/0272289 A1 * 11/2008 Vestal ..... H01J 49/025 250/287
2011/0139973 A1 * 6/2011 Bowdler ..... H01J 49/0004 250/252.1
2012/0145889 A1 * 6/2012 Vestal ..... H01J 49/403 250/282
2012/0145893 A1 * 6/2012 Vestal ..... H01J 49/403 250/286
2012/0168618 A1 * 7/2012 Vestal ..... H01J 49/40 250/282
2014/0014830 A1 * 1/2014 Hoyes ..... H01J 49/403 250/282
2016/0013039 A1 * 1/2016 Brown ..... H01J 49/403 250/282
2016/0064202 A1 * 3/2016 VanGordon ..... H01J 49/0418 250/282

FOREIGN PATENT DOCUMENTS

CN 103871830 A 6/2014
DE 196 38 577 B2 1/1998
DE 11 2005 001 158 A1 4/2007
JP 2002203510 A 7/2002

* cited by examiner

TIME-OF-FLIGHT MASS SPECTROMETER WITH SPATIAL FOCUSING OF A BROAD MASS RANGE

BACKGROUND OF THE INVENTION

Field of the Invention

The invention relates to measurement methods for time-of-flight mass spectrometers which operate with pulsed ionization of superficially adsorbed analyte substances and with an improvement in the mass resolution by means of a time-delayed start of the ion acceleration; in particular with ion-accelerating voltages which change over time after a delayed start in order to obtain a rather constant mass resolution over broad mass ranges.

Description of the Related Art

Time-of-flight mass spectrometers are often operated with pulsed ionization of superficially adsorbed analyte substances; methods for the ionization of samples by matrix-assisted laser desorption (MALDI) are known in particular. A plasma cloud, which expands and thus produces a distribution of the velocities of the plasma particles, is generated in the laser focus, said distribution being wider the further the plasma particles (ions and molecules) are from the surface. The velocity distribution means that the mass resolution can be improved by temporally delaying the start of the ion acceleration. Ions of a higher velocity then only pass through a portion of the accelerating field, and thus receive a lower additional acceleration, so the originally slower ions can catch up with them in a temporal focal point. Unfortunately, ions of different mass do not have exactly the same focal point. The focal points for ions of different mass can, however, be made to approach one another if ion-accelerating voltages are used which vary over time after a delayed start, particularly if they continuously increase or decrease (depending on polarity). In combination with a Mamyrin reflector, it is possible to obtain a high mass resolution which is approximately constant over large mass ranges (cf. documents DE 196 38 577 C1, GB 2 317 495 B or U.S. Pat. No. 5,969,348 A, J. Franzen, 1996).

The international patent application WO 2005/114699 A1 describes a standard ion lens system as a corrective ion optic element.

SUMMARY OF THE INVENTION

The invention is based on the finding that the accelerating field in the space in front of the sample support plate produces a lens effect in the typically round aperture of the accelerating electrode, and thus slightly defocuses the ion beam. Since fast ions with low masses leave this acceleration space quickly, the increasing accelerating field strength has a greater effect on the slow ions with large masses than on faster ions with low masses. This produces a broadening of the ion beam at right angles to the direction of flight, and the inventor has observed that this broadening increases with ion mass. The invention now proposes to compensate, to the desired extent, for the broadening of the ion beam with the aid of an additional ion-optical lens whose voltage is also varied over time. The lens can be an einzel lens, or more precisely an element of an einzel lens, or an acceleration lens, for instance.

For ions of a very broad mass range, it is quite possible to keep the ion beam at a diameter of approximately four millimeters (or less) by focusing with this additional lens while the ions pass through the first flight path, the reflector and the second flight path.

For some other operating modes, a diameter slightly above this minimum can be optimal. For example, at the point of reversal of the ions in the reflector, where the ions fly very slowly, the mass resolution may be reduced by the effect of the space charge if the ion beam is too narrow. Or the ion detector may be saturated by an ion density which is too high at some points. An optimum for the mass resolution and dynamic measuring range can thus be achieved by suitable variation of the function for the variable lens voltage. In any case, the beam diameter can be significantly reduced compared to an operating mode with static lens voltage.

In general, the reduction and homogenization of the beam diameter over a broad mass range produces better quantifiability of the ions because without these steps, the ion beam would broaden too much for it to be completely accepted or received by the geometry of the reflector and/or detector over a large mass range. The outer ions, especially at high charge-related masses m/z, would be lost to the measurement and thus also diminish its sensitivity.

BRIEF DESCRIPTION OF THE DRAWINGS

In FIG. 2, equipotential lines are drawn to illustrate the conditions during an accelerating voltage pulse, by way of example.

DETAILED DESCRIPTION

While the invention has been shown and described with reference to a number of embodiments thereof, it will be recognized by those skilled in the art that various changes in form and detail may be made herein without departing from the scope of the invention as defined by the appended claims.

As has been set out before, since the varying accelerating voltage in the acceleration space produces a broadening of the ion beam at right angles to the direction of flight, and this broadening increases with the ion mass, the invention proposes to compensate, to the desired extent, for the broadening of the ion beam with the aid of an additional ion-optical lens whose voltage is also varied over time.

Figure 1:
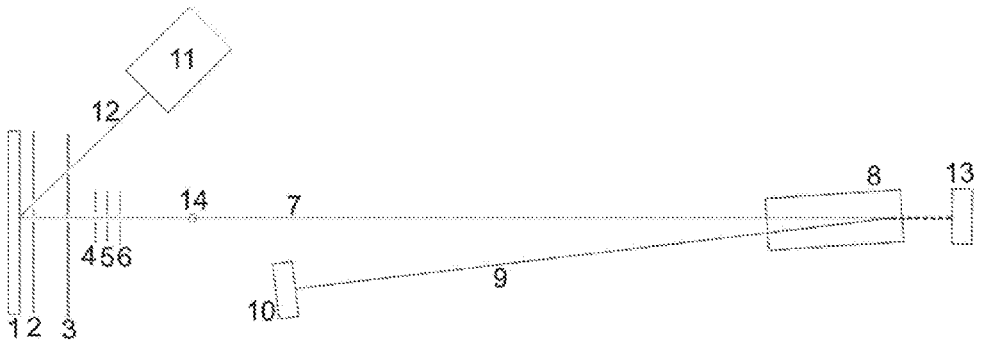
FIG. 1 shows a simplified schematic representation of a MALDI time-of-flight mass spectrometer. Samples on a sample support plate (1), which together with the accelerating electrode (2) is at a high voltage of 20 to 30 kilovolts, are bombarded with nanosecond light pulses (12) from a pulsed UV laser (11). A plasma is created each time, which expands undisturbed in the initially field-free space between sample support plate (1) and electrode (2). After a delay of a few tenths of a microsecond, the voltage on the accelerating electrode (2) is adjusted so that the ions are accelerated, whereby temporal focusing is achieved for ions of the same mass at a location which can be shifted at will, for example to location (14), as a function of the time delay and the accelerating voltage. Most of the acceleration takes place between the accelerating electrode (2) and the base electrode (3), which is at ground potential in normal operation. An einzel lens (4, 5, 6) focuses the slightly divergent ion beam (7), which enters the Mamyrin-type reflector (8) after the first straight flight path, is reflected there and impinges on the ion detector (10) after a second flight path (9). For a linear mode of operation, the reflector (8) can be switched off and the ion current can be measured in a second detector (13) without reflection.
Figure 2:
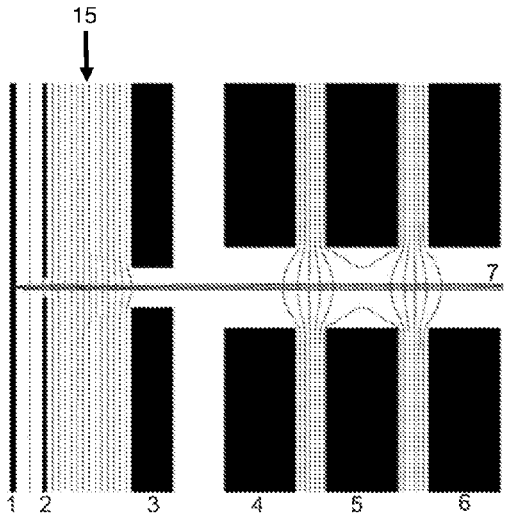
FIG. 2 is also a schematic representation, albeit in more detail, of the ion source of the time-of-flight mass spectrometer from FIG. 1.

A greatly simplified schematic diagram of a MALDI time-of-flight mass spectrometer (MALDI-TOF) and a more detailed view of a corresponding ion source are shown in FIGS. 1 and 2. The samples on the sample support plate (1), which together with the accelerating electrode (2) is initially at a constant high voltage of around 20 to 30 kilovolts, are bombarded with nanosecond light pulses (12) of 1 to 10 nanoseconds duration from a pulsed UV laser (11). Each laser pulse creates a tiny plasma cloud at the impact location, and this cloud expands unhindered in the initially field-free space between sample support plate (1) and accelerating electrode (2). After a delay tv of a few tenths of a microsecond, for example, the voltage on the accelerating electrode (2) is switched so that the ions are accelerated, whereby temporal focusing for ions of the same mass is achieved at a selectable location, for example location (14), in the known way. Most of the acceleration does not, however, usually take place between the sample support plate (1) and the accelerating electrode (2), but in the acceleration space (15) between the accelerating electrode (2) and the base electrode (3), which is at ground potential in normal operation. This is of no consequence for the invention, however. The different field strengths on either side of the accelerating electrode (2) produce a lens effect in the aperture of the accelerating electrode (2), causing the ion beam to become slightly divergent. An einzel lens (4, 5, 6) focuses the slightly divergent ion beam (7), which enters the Mamyrin-type reflector (8) after the first straight flight path, is reflected there and impinges on the ion detector (10) after a second flight path (9).

The location (14) for the temporal focus of the ions can be selected at will via the time delay and amplitude of the accelerating voltage. It is usual to select a location which, as shown in FIG. 1, is not too far away from the ion source. This location (14) for the temporal focus, through which ions of the same mass pass simultaneously but with slightly different energies, is imaged onto the detector (10) by the energy-focusing reflector (8) so as to be temporally focused again.

Figure 3:
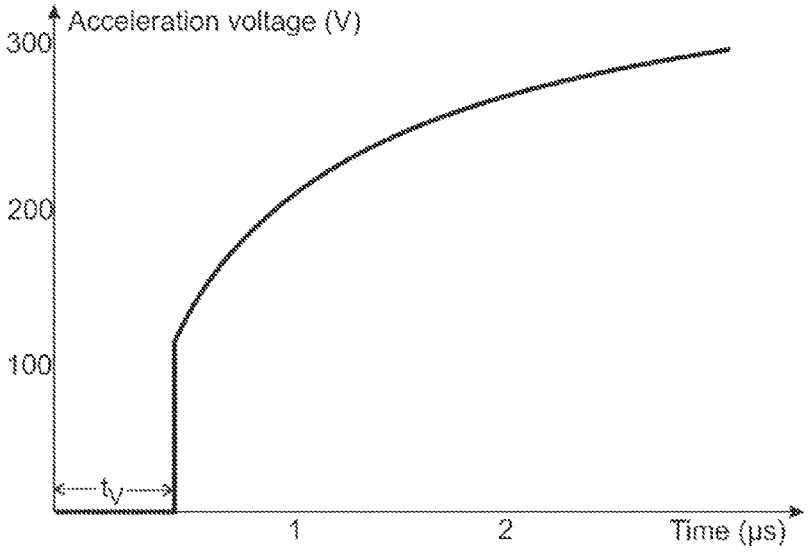
FIG. 3 is a diagram of the accelerating voltage between the plates (1) and (2), referenced to the high voltage on the sample support plate (1). The accelerating voltage is switched on after a time delay $t_v$; later it is increased in this example in order to achieve roughly the same mass resolution for ions of all masses.

Unfortunately, the location (14) for the first temporal focusing of the ions is not at exactly the same position for ions of different mass. In fact, the focal length depends slightly on the mass of the ions. In order to make the location of the temporal focus approximately the same for ions of all masses, there is an operating mode in which the accelerating voltage is continuously varied after the delayed start of acceleration of the ions. The temporal variation of the accelerating voltage between sample support plate (1) and accelerating electrode (2) is depicted in the diagram of FIG. 3, by way of example. This ensures that the focal length for the temporal focusing of the ions becomes rather constant over a broad mass range, with the consequence that the mass resolving power is also consistently high over a large mass range, as desired. It is to be noted that, without delayed acceleration such as illustrated by curve (22) in FIG. 5, the temporal resolution as one of the most significant figures of merit for a TOF mass spectrometer is too low for most contemporary applications.

As has already been mentioned, the typically round aperture of the accelerating electrode (2) acts like a lens because the field strengths on either side of the accelerating electrode (2) are different. This causes the ion beam (7) to become slightly defocused. Since fast ions with low masses leave this acceleration space quickly, the increasing accelerating field strength has a greater effect on the slow ions with large masses than on faster ions with low masses. This produces a broadening of the ion beam at right angles to the direction of flight, and this broadening increases with ion mass; as depicted by the curve (20) in the diagram of FIG. 5.

Figure 4:
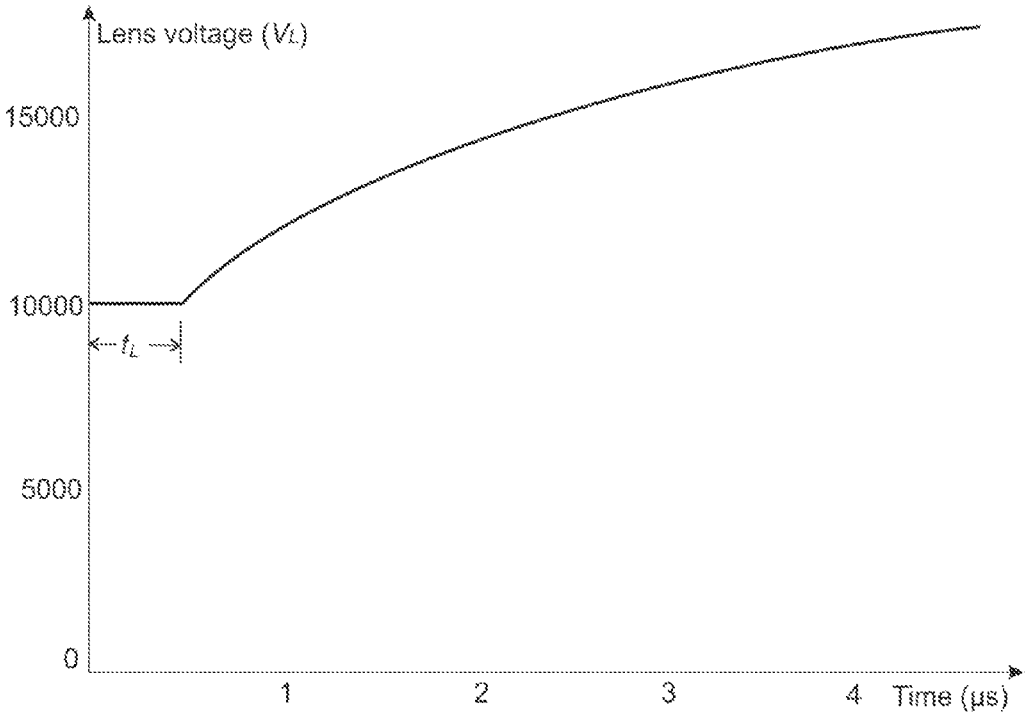
FIG. 4 is a diagram of the varying lens voltage according to the invention. After the time delay $t_L$, the lens voltage increases in this example.

The invention now proposes to compensate, to the desired extent, for the mass-dependent broadening of the ion beam by temporally varying the voltage of the middle element (5) of the einzel lens (4,5,6), which is used here by way of example. The lens voltage is varied during the spectral acquisition as a function of the time of flight and hence of the mass. As illustrated in FIGS. 1 and 2, the lens can be an einzel lens, but it is also possible to use an accelerating lens which does not have the same potential on both sides of the lens and represents part of the whole acceleration system. The lens voltage of an einzel lens is applied commonly only to the center diaphragm. An example of the temporal variation of the lens voltage is shown in the diagram of FIG. 4. The variation starts after a time delay at the lens of $t_L$. The time delay at the lens $t_L$ can, in particular, be identical to the time delay $t_v$ for the accelerating voltage. After the mass spectrum has been acquired, the lens voltage returns to the initial value again in preparation for the next laser pulse.

Different functions can be selected for the variation of the lens voltage. An exponential variation is simple to generate electrically, for example $$U_L = V_1 + W_1 \times \left\{1 - \exp\left(-\frac{t - t_L}{t_1}\right)\right\},$$

where the lens voltage $U_L$ at time $t_L$ starts with the base voltage $V_1$ and approaches the limit value $(V_1+W_1)$ with the time constant $t_1$. As has already been mentioned, the time $t_L$ can be identical to the time delay $t_v$. A curve of this type is shown in the time diagram in FIG. 4.

The time-of-flight mass spectrometer used, which is provided with ionization of the ions by matrix-assisted laser desorption, having a power supply for a delayed start and a varying accelerating voltage for the ions, and having a lens for spatial focusing of the ion beam, must therefore have a power supply for the lens which can supply a variable voltage on a short timescale, in the order of microseconds, during the spectral acquisition.

It should be noted here that a varying lens voltage requires a new mass calibration of the mass spectrometer, since a changed lens voltage has the effect of changing the dwell time of the ions in the lens. Such an adjustment is considered to be easily within the routine skill of a practitioner in this field, so no further explanation is required here.

Figure 5:
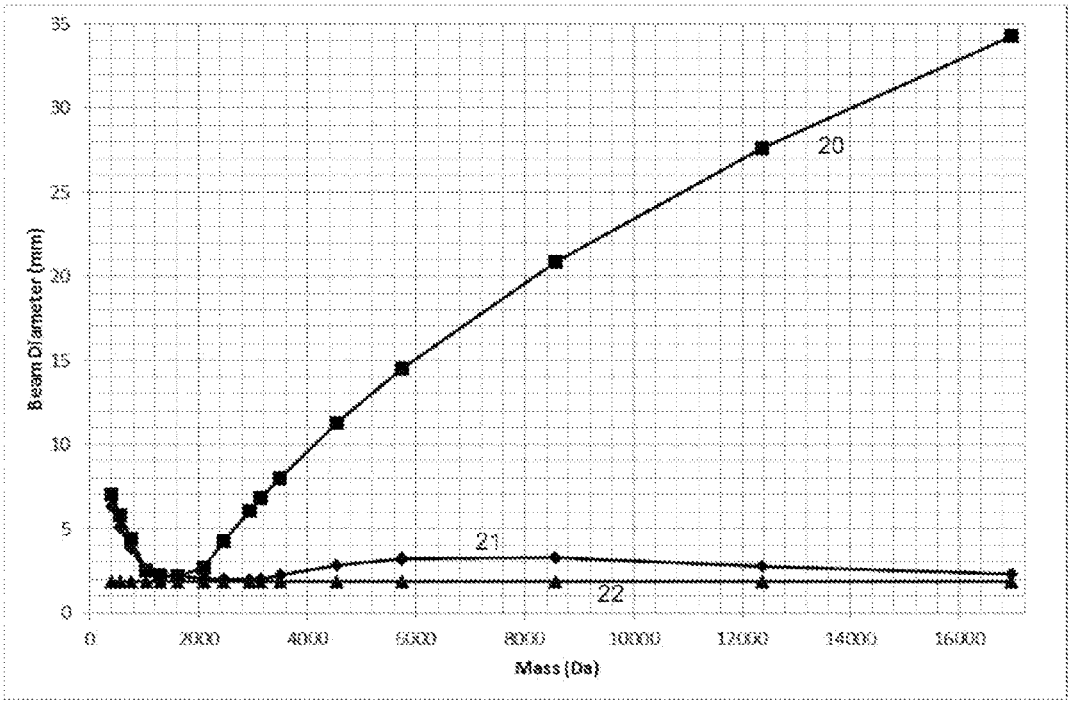
FIG. 5 depicts the ion beam diameter at right angles to the direction of flight as a function of the mass of the ions for different operating modes. The bottom curve (22) shows the diameter when the accelerating voltage is switched on permanently, i.e. no delayed acceleration takes place, for comparison purposes. The top curve (20) illustrates the increase in the beam diameter as the accelerating voltage increases after the delayed switch-on, but with constant lens voltage. The curve in the middle (21) represents the diameter as it behaves with additionally varying lens voltage, as shown by way of example in the diagram of FIG. 4. The beam diameter can be kept at a value which is considerably below four millimeters, sufficiently narrow for the acceptance area of a reflector and/or detector, so that no ions (or at least far fewer) are lost to the measurement thereby increasing throughput and thusly sensitivity.

The diagram in FIG. 5 shows the diameters of the ion beam as a function of the mass of the ions for three operating modes, as are produced from a simulation with the SIMION™ program. The bottom curve (22) shows the development of the beam diameter as obtained without applying the delayed acceleration, when the lens voltage is set correctly, for comparison purposes. The top curve (20) shows the increase in the beam diameter as the accelerating voltage increases after a delayed switch-on, but with a constant lens voltage. As can be seen, there is a comparatively narrow range of minimal beam diameter between about 1000 and 2000 atomic mass units. The middle curve (21), in contrast, which is obtained by optimum variation of the lens voltage, keeps the diameter of the ion beam at significantly less than four millimeters for ions of all masses by focusing with this additional lens while the ion beam passes through the first flight path, the reflector and the second flight path. This setting can be useful especially for applications which generate many spontaneously decaying ions in the ion source (also known as in-source decay: ISD).

For some operating modes, an ion beam diameter that is (slightly) larger than this minimum may be optimal. If, for example, high ion currents exist at the point of reversal of the ions in the reflector, where the ions fly very slowly, the effect of the space charge may cause the ions to mutually interfere, which leads to a reduction in the mass resolution. On the other hand, an ion detector, for example a multichannel plate, may be overloaded by too high an ion density at a particular point. In such cases, an optimum mass resolution, dynamic measuring range and/or sensitivity can be achieved by varying the temporal characteristic of the variable lens voltage. In any event, this achieves a significant improvement compared to the beam diameter as shown as curve (20) in FIG. 5, which results from an operating mode without temporal variation of the lens voltage.

In some commercial time-of-flight mass spectrometers, it is possible to reflect a slightly divergent ion beam in the reflector onto the ion detector by solid angle focusing (cf. documents U.S. Pat. No. 6,740,872 B1 or GB 2 386 750 B; A. Holle, 2001). To this end, the equipotential surfaces in the reflector, near the ions' point of reversal, are slightly curved. The focusing is ideal only for ion beams of a limited diameter, however. Setting of the lens voltage variation according to the invention can be used here to illuminate the reflector in an ideal way. An optimum setting can be found by measuring the mass resolution and the sensitivity under varied conditions.

A time-of-flight mass spectrometer can also be operated without a reflector (or with the reflector switched off) in linear mode. In FIG. 1, a second ion detector (13) is provided for this operating mode, and the ion beam travels on to this second detector when the operating voltage of the reflector (8) is switched off. The variation of the lens voltage according to the invention can be used here to optimally illuminate the ion detector for ions of all masses (or at least a large range of masses).

Many time-of-flight mass spectrometers with reflectors are also equipped for measuring daughter ions of selected parent ions. The parent ions are selected by a "parent-ion selector" (not shown) at the location of the first temporal focus (14). It is a fast deflector which deflects ions of all masses and removes them from the ion path, the only exception being the selected parent ions. Here too, a lens voltage varying according to the invention can improve mass resolution and sensitivity.

The invention has been shown and described with reference to a number of different embodiments thereof. It will be understood, however, that various aspects or details of the invention may be changed, or various aspects or details of different embodiments may be arbitrarily combined, if practicable, without departing from the scope of the invention. Generally, the foregoing description is for the purpose of illustration only, and not for the purpose of limiting the invention which is defined solely by the appended claims.

The invention claimed is:

1. A time-of-flight mass spectrometer having an ion source that operates with ionization of ions by matrix-assisted laser desorption, further having an accelerating voltage power supply to delay the start of, and to vary, an accelerating voltage for the ions and having an ion-optical lens for spatially focusing a resultant ion beam, wherein a lens power supply for the ion-optical lens is configured to supply a voltage variable on a short time scale on the order of microseconds so that low-mass ions flying ahead in the ion beam are subject to different spatial focusing than large-mass ions trailing behind in the ion beam during a same spectral acquisition, wherein the voltage applied to the ion-optical lens is configured to be varied in such a way that a diameter of the ion beam is less than five millimeters in a range between around 1000 and 17000 atomic mass units.

2. The time-of-flight mass spectrometer according to claim 1, wherein the ion-optical lens is an einzel lens.

3. The time-of-flight mass spectrometer according to claim 2, wherein a variable spatial focusing voltage is supplied to a center element of the einzel lens.

4. The time-of-flight mass spectrometer according to claim 1, wherein the ion beam is directed onto a detector one of directly in a linear mode of operation and indirectly via redirection in a reflector.

5. The time-of-flight mass spectrometer according to claim 1, wherein the ion-optical lens is located downstream from an acceleration space where the acceleration of the ions takes place.

6. The time-of-flight mass spectrometer according to claim 1, wherein the lens power supply provides a spatial focusing voltage with a variation according to an exponential function.

7. The time-of-flight mass spectrometer according to claim 1, wherein the ion-optical lens is part of the ion source.

8. A method for generating a narrow ion beam in a time-of-flight mass spectrometer having an ion source that operates with ionization of ions by matrix-assisted laser desorption, wherein, after ionization, the ions are accelerated onto a flight path with delay while varying an accelerating voltage over time, further comprising spatial focusing of a resultant ion beam by means of an ion-optical lens, wherein the ions are focused at right angles to a direction of flight as a function of a time of flight by means of temporal variation of a voltage applied to the ion-optical lens, wherein the voltage applied to the ion-optical lens is varied in such a way that a diameter of the ion beam is less than five millimeters in a range between around 1000 and 17000 atomic mass units.

9. The method according to claim 8, wherein a function for a time-of-flight dependence of the voltage applied to the ion-optical lens is selected so that the ion beam can be accepted or received by at least one of reflector and detector without any losses due to the geometry.

10. The method according to claim 8, wherein the delay is on the order of tenths of a microsecond.

11. The method according to claim 8, wherein a diameter of the ion beam is reduced and homogenized over a mass range of several thousand atomic mass units using the temporal variation of the voltage applied to the ion-optical lens so as to produce better quantifiability of the ions.

12. The method according to claim 8, wherein a mass spectrum is acquired from the ions in the ion beam, and the mass spectrum is investigated for fragments of the ions having arisen from in-source decay.

13. The method according to claim 9, wherein the ion beam illuminates an ion reflector that is configured for solid angle focusing.

14. The method according to claim 8, wherein the diameter of the ion beam is set to be four millimeters or less.

15. A method for generating a narrow ion beam in a time-of-flight mass spectrometer having an ion source that operates with ionization of ions by matrix-assisted laser desorption, wherein, after ionization, the ions are accelerated onto a flight path with delay while varying an accelerating voltage over time, further comprising spatial focusing of a resultant ion beam by means of an ion-optical lens, wherein the ions are focused at right angles to a direction of flight as a function of a time of flight by means of temporal variation of a voltage applied to the ion-optical lens, wherein a function for a time-of-flight dependence of the voltage applied to the ion-optical lens after a time delay $t_v$ follows an exponential function $$U_L = V_1 + W_1 \times \left\{1 - \exp\left(-\frac{t - t_L}{t_1}\right)\right\},$$

where the variation of the voltage applied to the ion-optical lens $U_L$ begins at a start time $t_L$ with a base voltage $V_1$ and approaches a limit value $(V_1+W_1)$ with a time constant $t_1$, where $W_1$ is a scaling parameter in volts.

16. The method according to claim 15, wherein at least one of mass resolution and sensitivity are optimized via the voltages $V_1$ and $W_1$, the time constant $t_1$ and the starting time $t_L$ for the variation of the voltage applied to the ion-optical lens.

17. The method according to claim 15, wherein the starting time $t_L$ for the variation of the voltage applied to the ion-optical lens is identical to a time delay $t_v$ for the acceleration of the ions.

18. The method according to claim 15, wherein the scaling parameter $W_1$ amounts to several thousand volts.

19. A time-of-flight mass spectrometer having an ion source that operates with ionization of ions by matrix-assisted laser desorption, further having an accelerating voltage power supply to delay the start of, and to vary, an accelerating voltage for the ions and having an ion-optical lens for spatially focusing a resultant ion beam, wherein a lens power supply for the ion-optical lens is configured to supply a voltage variable on a short time scale on the order of microseconds so that low-mass ions flying ahead in the ion beam are subject to different spatial focusing than large-mass ions trailing behind in the ion beam during a same spectral acquisition, wherein a function for a time-of-flight dependence of the voltage applied to the ion-optical lens after a time delay $t_v$ is configured to follow an exponential function $$U_L = V_1 + W_1 \times \left\{1 - \exp\left(-\frac{t - t_L}{t_1}\right)\right\},$$

where the variation of the voltage applied to the ion-optical lens $U_L$ begins at a start time $t_L$ with a base voltage $V_1$ and approaches a limit value $(V_1+W_1)$ with a time constant $t_1$, where $W_1$ is a scaling parameter in volts.

* * * * *